US012213513B2

(12) United States Patent
Chen et al.

(10) Patent No.: US 12,213,513 B2
(45) Date of Patent: Feb. 4, 2025

(54) LOW-TEMPERATURE SMOKING BODY AND PREPARATION METHOD THEREOF

(71) Applicant: CHINA TOBACCO HUNAN INDUSTRIAL CO., LTD., Hunan (CN)

(72) Inventors: Qian Chen, Hunan (CN); Ke Li, Hunan (CN); Yong Jin, Hunan (CN); Saibo Yu, Hunan (CN); Hongmei Fan, Hunan (CN); Shitai Wang, Hunan (CN); Chao Tan, Hunan (CN); Haifeng Tan, Hunan (CN); Qi Liu, Hunan (CN); Jianhua Yi, Hunan (CN); Wen Du, Hunan (CN); Xinqiang Yin, Hunan (CN); Xinliang Tan, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 639 days.

(21) Appl. No.: 17/057,598

(22) PCT Filed: Mar. 19, 2019

(86) PCT No.: PCT/CN2019/078652
§ 371 (c)(1),
(2) Date: Nov. 20, 2020

(87) PCT Pub. No.: WO2019/223411
PCT Pub. Date: Nov. 28, 2019

(65) Prior Publication Data

US 2021/0401030 A1 Dec. 30, 2021

(30) Foreign Application Priority Data

May 21, 2018 (CN) ..... 201810486784.1
May 21, 2018 (CN) ..... 201810486790.7
(Continued)

(51) Int. Cl.
*A24C 5/01* (2020.01)
*A24B 15/14* (2006.01)
(Continued)

(52) U.S. Cl.
CPC ..... *A24C 5/01* (2020.01); *A24B 15/14* (2013.01); *A24B 15/16* (2013.01); *A24B 15/167* (2016.11);
(Continued)

(58) Field of Classification Search
CPC ..... A24C 5/01; A24B 15/167; A24B 15/186; A24D 1/20
See application file for complete search history.

(56) References Cited

U.S. PATENT DOCUMENTS 5,156,170 A 10/1992 Clearman et al.
2011/0104218 A1* 5/2011 Karles ..... B01J 13/22 424/463
(Continued)

FOREIGN PATENT DOCUMENTS

CN 103179869 A 6/2013
CN 103960783 A 8/2014
(Continued)

OTHER PUBLICATIONS

Particle Size and Mesh chart (Year: 2024).*
International Search Report issued in International Application No. PCT/CN2019/078652 dated Jun. 20, 2019, 5 pages.

*Primary Examiner* — Christopher M Rodd
*Assistant Examiner* — Jennifer A Kessie
(74) *Attorney, Agent, or Firm* — MASCHOFF BRENNAN; Michael Mauriel

(57) ABSTRACT

A low-temperature smoking body and a preparation method thereof are disclosed. The low-temperature smoking body includes tobacco particles. The tobacco particle includes a
(Continued)

particle body and a shell wrapped on the particle body. A carrier is distributed in the particle body and/or the shell. The carrier includes at least one of a raw tobacco material, a non-tobacco material, and a porous material. The carrier carries a smoking agent, and the smoking agent includes a tobacco extract and/or an atomizer. In addition, a preparation method of the low-temperature smoking body is further disclosed. The low-temperature smoking body has better smoking stability and uniformity, and the tobacco particles having core-shell structures can effectively solve the problem of liquid leakage.

15 Claims, 1 Drawing Sheet

(30) Foreign Application Priority Data

May 21, 2018 (CN) ..... 201810486801.1
May 21, 2018 (CN) ..... 201810486814.9
May 21, 2018 (CN) ..... 201810486822.3

(51) Int. Cl.
*A24B 15/16* (2020.01)
*A24B 15/167* (2020.01)
*A24B 15/18* (2006.01)
*A24B 15/28* (2006.01)
*A24D 1/20* (2020.01)

(52) U.S. Cl.
CPC ..... *A24B 15/186* (2013.01); *A24B 15/285* (2013.01); *A24D 1/20* (2020.01)

(56) References Cited

U.S. PATENT DOCUMENTS

2011/0232657 A1* 9/2011 Karles ..... A24B 15/283 131/300
2018/0295885 A1* 10/2018 Rojo-Calderon ..... A24F 40/465

FOREIGN PATENT DOCUMENTS

CN 104366687 A 2/2015
CN 105614945 A 6/2016
CN 105815815 A 8/2016
CN 106455714 A 2/2017
EP 0 337 507 A2 10/1989
WO 2018/087164 A1 5/2018

* cited by examiner

LOW-TEMPERATURE SMOKING BODY AND PREPARATION METHOD THEREOF

CROSS REFERENCE TO RELATED APPLICATIONS

This application is a U.S. National Phase application under 35 U.S.C. § 371 of International Application No. PCT/CN2019/078652 filed on Mar. 19, 2019, which claims priority to Chinese Application No. 201810486814.9 filed on May 21, 2018, Chinese Application No. 201810486790.7 filed on May 21, 2018, Chinese Application No. 201810486801.1 filed on May 21, 2018, Chinese Application No. 201810486784.1 filed on May 21, 2018, and Chinese Application No. 201810486822.3 filed on May 21, 2018. The entire contents of these applications are hereby incorporated herein by reference.

FIELD OF THE INVENTION

The present invention relates to a low-temperature smoking body and a preparation method thereof, belonging to the field of low-temperature cigarettes.

BACKGROUND OF THE INVENTION

With the advances in science and technology and the general increase in people's health consciousness, new tobacco products have been developed dramatically. Low-temperature non-burning cigarettes, as one of the main products, are especially valued by major research institutions and enterprises. At present, the low-temperature non-burning cigarette products on the market mainly use special electric heating devices to fill tobacco materials such as cigarettes, cut tobacco or tobacco slices therein, and the smoke in the tobacco filling materials is volatilized by means of electric heating, so that the smoker gets a smoking experience similar to that of traditional tobacco. However, this type of low-temperature smoking body generally has the problems such as insufficient smoke, unevenness throughout smoking, and less smoking experience.

Chinese patent CN201610232919 discloses a cigarette column suitable for low-temperature cigarettes, which is formed by mixing tobacco particles, a thermally conductive ingredient, a binder, a tobacco flavor and a moisturizer uniformly. The cigarette column has the advantages of a large amount of smoke and smooth smoking, but has the disadvantages that the cigarette column is still moist even after drying, which is not conducive to storage, prone to leakage, and seriously affects its usability. At the same time, its smoking stability and uniformity are poor, the nicotine content is too high when smoking, and the irritation is high. In addition, there is also the problem of slow smoking.

SUMMARY OF THE INVENTION

The technical problems solved by the present invention are that in the prior art, low-temperature non-burning cigarettes have insufficient smoke, less smoking experience and poor smoking stability and uniformity throughout, and the smoking body is prone to tobacco tar leakage.

In order to solve the above technical problem, the technical solution of the present invention is as follows:

A low-temperature smoking body, including tobacco particles, wherein the tobacco particle includes a particle body and a shell wrapped on the particle body, a carrier is distributed in the particle body and/or the shell, the carrier includes at least one of a raw tobacco material, a non-tobacco material and a porous material, the carrier carries a smoking agent, and the smoking agent includes a tobacco extract and/or an atomizer.

As one of the embodiments of the present invention, the carrier is a raw tobacco material. The raw tobacco material can be used as one of the smoking materials, and can also be used as the carrier of the tobacco extract and/or the atomizer, so that the raw tobacco material, the tobacco extract and the atomizer are uniformly distributed in the particle bodies to ensure the amount of smoke and increase the puffs of smoking; and with the design of shells on the particle bodies, the smoking agent can be isolated from the outside to solve the problem of leakage.

As another embodiment of the present invention, the carrier includes a raw tobacco material and/or a non-tobacco material, and the smoking agent includes a tobacco extract and an atomizer. In this way, the tobacco extract and the atomizer are loaded on the carrier, so that the tobacco extract and the atomizer are uniformly distributed in the particle bodies to ensure the amount of smoke and increase the puffs of smoking; and with the shells, the tobacco extract and the atomizer can be effectively isolated from the outside to solve the problem of leakage.

As another embodiment of the present invention, the carrier is a porous material, and the shell contains a tobacco powder material. The smoking agent is loaded in the porous material inside the tobacco particles, and the porous material has high porosity, so a lot of the smoking agent is loaded to meet the demand for the puffs of smoking and ensure the stability of smoking; and the tobacco powder material in the shells blocks the contact between the internal ingredients of the particles and the outside, which is more conducive to storage and effectively solves the problem of liquid leakage.

Further, the tobacco powder material has a particle size of 100-200 meshes, preferably 120-180 meshes. Further, the smoking agent includes a tobacco extract and an atomizer, and preferably, the mass ratio of the tobacco powder material, the tobacco extract and the atomizer is 100:(1-15):(5-30). It ensures that the smoking body has good smoking ability and good smoking taste.

Further, the atomizer includes one or more of glycerin, propylene glycol, and glycerol.

Further, the atomizer includes glycerin, propylene glycol and glycerol, and the mass ratio of the three is (0-10):(0-20):(0-30), preferably (2-8):(4-16):(5-25). Further, the smoking agent includes a tobacco extract and an atomizer, and the mass ratio of the carrier, the tobacco extract and the atomizer is (50-150):(1-15):(5-30), further 100:(1-15):(5-30), and preferably 100:(5-10):(10-20).

With a proper ratio, the smoking body can have good smoking ability and good smoking taste.

Further, the carrier includes a raw tobacco material and a non-tobacco material, and further, the mass ratio of the raw tobacco material, the non-tobacco material, the tobacco extract and the atomizer is 100:(20-100):(1-15):(5-30).

Further, the porous material includes an organic porous material/or an inorganic porous material; and preferably, the porous material includes a natural organic porous material/or a natural inorganic porous material.

Further, the porous material includes at least one of corncob particles, rice husk particles, walnut shell particles, grapefruit peel particles, tobacco stem particles, tea particles, porous silica gel, active carbon, porous ceramic particles, and porous molecular sieves.

Further, the non-tobacco material includes at least one of microcrystalline cellulose, tea, sugarcane fibers, hemp pulp fibers, bamboo fibers, coconut fibers, starch, coffee shells, and mint leaves. Optionally, the starch is pre-gelatinized starch. The use of the non-tobacco material can dilute the raw tobacco material, thereby greatly reducing the nicotine content and reducing the irritation when smoking; at the same time, the use of some materials can help control the granulation process or give the tobacco particles a special smoking flavor.

Further, a magnetic material is distributed in the particle bodies, and preferably, the magnetic material includes at least one of ferrite, iron alloy and nickel alloy. Based on the principle of electromagnetic induction heating, the tobacco particles can be quickly heated from inside to outside by means of the magnetic material inside a cigarette set to produce smoke. In this way, when smoking, the tobacco particles are heated from inside to outside, which improves the heating efficiency and atomizes the smoking agent thoroughly; further, the shells contain a carrier, then when smoking, the inner parts of the shells generate smoke first, the generated high-temperature smoke passes through the shells and diffuses outward, and the high-temperature smoke can preheat the outer parts of the shells during the process of diffusion, thereby improving the smoking efficiency and ensuring the smoking stability; in addition, the heat source is located inside the tobacco particles, and the heat generated by the cores is naturally transferred to the outside through the shells, so the heat transfer performance is good, and the problem of slow smoking caused by insufficient heat at the shells does not need to be worried. In this way, the obtained low-temperature smoking body is suitable for electromagnetic heating. When the low-temperature smoking body is used for a low-temperature cigarette set, the smoking speed is fast, the amount of smoke is sufficient, the smoking is smooth, the sense of satisfaction is strong, many puffs of smoking can be realized, and the low-temperature smoking body is suitable for various low-temperature cigarette sets or tobacco pipes.

As one of the optional solutions, the particle body is made of a magnetic material, and the carrier is distributed in the shell. Further, the carrier has a particle size of 100-200 meshes, further preferably 120-180 meshes.

Further, the carrier has a particle size of 40-200 meshes, optionally 40-80 meshes, and further 50-75 meshes. The proper particle size can ensure that the tobacco particles can grow up smoothly during the preparation process, and the proportion of the tobacco particles is not too large. The tobacco particles have a diameter of 10-40 meshes, optionally 20-40 meshes, and optionally 10-30 meshes; and the moisture content of the tobacco particles is 6-25 wt %, optionally 8-20 wt %, optionally 6-15 wt %, and preferably 8-12 wt %. Optionally, the moisture content is 10-12 wt %.

After the smoking body is made, the proper moisture content can ensure that no mildew will occur during the storage of the smoking body, and also ensures a better smoking taste; the proper particle size can ensure the stability and smoothness of smoking, and make the interior of the smoking body have good air permeability and low sucking resistance.

If the diameter of the tobacco particles is too small, the interior of the the low-temperature smoking body is prone to low air permeability, which affects smoking and smoking feeling; if the diameter of the tobacco particles is too large, the appearance of the low-temperature smoking body is not attractive enough, and the smoking speed slows down; in addition, when the shells have a bonding ability, the proper amount of moisture in the tobacco particles is beneficial to stimulating the bonding ability of the shells on the surfaces of the tobacco particles during subsequent treatment, so that the tobacco particles can be quickly bonded.

Further, the tobacco particles are spherical or nearly spherical.

Further, the shells are made of a material with a bonding ability.

In some embodiments of the present invention, the shells contain one or more of hydroxypropyl methyl cellulose, hydroxypropyl cellulose, povidone, sodium carboxymethyl cellulose, microcrystalline cellulose, polyethylene glycol, and polyvinyl alcohol. In this way, the shells can partially block the atomizer and the tobacco extract inside the particles from leaking out, so that the particles have better appearance and fluidity. At the same time, the shells have a bonding ability, so that the tobacco particles can be quickly bonded during subsequent treatment.

Further, a tobacco powder layer is also provided between the particle body and the shell, so that the shell and the tobacco powder layer form double anti-leakage protection for the particle body, thereby effectively solving the problem of liquid leakage. Preferably, the mass ratio of the tobacco powder layer to the particle body is 100:(5-25).

Further, the mass ratio of the shells to the tobacco particles is (0.1-5):100. The proper ratio is controlled to reduce the influence on the smoking flavor. In the case that the shells have the bonding ability, the tobacco particles are bonded by virtue of their own bonding properties.

In some embodiments of the present invention, the shells contain a tobacco powder material.

Optionally, the low-temperature smoking body has a honeycomb structure. Further, the low-temperature smoking body is in the shape of one of a rod, a sheet and a block.

Further, the low-temperature smoking body is a loose and air-permeable cylinder, rhomboid, cube or of other specific shape. Different shapes adapt to different cigarette sets or tobacco pipes.

Further, the low-temperature smoking body has a porous and air-permeable structure, and its internal effective porosity is 65-95%, further 75-90%. The proper effective porosity can ensure the air permeability inside the smoking body and make its smoking easier and smoother and smoke production faster.

Preferably, the moisture content of the low-temperature smoking body is 5-13 wt %, which can prevent the smoking body from being mildewed during storage, and ensure a good smoking taste.

In some embodiments of the present invention, the low-temperature smoking body has a cavity structure; further, the low-temperature smoking body is cylindrical, the cavity structure extends along the length of the low-temperature smoking body, and preferably, the cross section of the cavity structure is one of circle, ellipse, square, and rhombus; preferably, the moisture content of the low-temperature smoking body is 6-12 wt %, and further, the effective porosity of the solid part of the low-temperature smoking body is 40-80%.

In the low-temperature smoking body with a cavity structure, a lot of voids are formed between the particles of its solid part, which can ensure that the smoke generated by the tobacco particles is smoothly sucked away. The design of the cavity structure can reduce the sucking resistance of the all-particle smoking body, ensure smoother smoking, provide a space for the extension of a central heater, simultaneously achieve four-side heating and center heating of the low-temperature smoking body, increase the smoking speed, and ensure that the tobacco particles at all parts of the smoking body are effectively used for smoking. The low-temperature smoking body can be used for low-temperature cigarette sets with four-side heating or center heating or both.

Based on the same inventive concept, the present invention provides a preparation method of the low-temperature smoking body, wherein the tobacco particles are placed in a mold and solidified to obtain the finished low-temperature smoking body.

Further, the solidification includes microwave solidification or heat solidification. The moisture inside the tobacco particles is volatilized quickly by the microwave or heat solidification, so that the moisture content of the low-temperature smoking body can be reduced to a reasonable level; and the bonding ability of the surface shells can be stimulated in the process of moisture volatilization and seepage, so that the tobacco particles are firmly bonded into a low-temperature smoking body of a proper shape.

Further, a preparation method of the tobacco particles is as follows:

mixing a carrier and a smoking agent uniformly, granulating, and sizing to obtain particle bodies, wherein the carrier is a raw tobacco material and/or a non-tobacco material; and preparing shells on surfaces of the particle bodies to obtain finished tobacco particles; or, spraying a smoking agent onto a porous material, followed by uniform mixing; granulating with the porous material loaded with the smoking agent as cores (particle bodies) and a mixture of a tobacco powder material and a first binder as a shell material, drying and sieving to obtain finished tobacco particles.

Preferably, the first binder includes polyvinyl alcohol and/or carboxymethyl cellulose; or, a tobacco extract and an atomizer are mixed uniformly, and then granulated and dried together with a carrier, a first binder, and cores (particle bodies) containing a magnetic material to obtain finished tobacco particles.

Further, the granulation method may be a conventional granulation method.

Preferably, a sieving step is also included after drying.

Optionally, a preparation method of the tobacco particles includes the following steps:

(1) mixing a carrier, a tobacco extract and an atomizer uniformly, granulating and sizing to obtain granule bodies; and (2) preparing shells on surfaces of the particle bodies obtained in step (1) to obtain finished tobacco particles.

Further, the preparation method further includes a step of pulverizing the carrier before step (1), and further, the raw tobacco material is pulverized to 100-200 meshes under the condition of not more than 60° C. to ensure the aroma of the raw tobacco material to the greatest extent.

Further, in step (1), before granulating, a wetting agent is added to the carrier, the tobacco extract and the atomizer, followed by uniform mixing. The addition of the wetting agent can improve the molding performance of the raw material mixture.

Further, the wetting agent includes water and/or alcohol. Further, the mass ratio of the wetting agent to the raw tobacco material is (5-30):100. The addition of the wetting agent can ensure better molding of the tobacco particles.

Further, the carrier is a raw tobacco material, and the ratio of the raw tobacco material, the tobacco extract, the atomizer and the wetting agent during the granulation process is 100:(1-15):(5-30):(0-25), preferably 100:(5-10):(10-25):(5-20).

Further, the carrier is a mixture of a raw tobacco material and a non-tobacco material, and the mass ratio of the raw tobacco material, the non-tobacco material, the tobacco extract, the atomizer and the wetting agent during the granulation process is 100:(20-100):(1-15):(5-30):(0-25).

Further, a step of preparing a tobacco powder layer on the surfaces of the particle bodies is further included between step (1) and step (2), that is, after the surfaces of the cores are coated with tobacco powder, particle bodies coated with tobacco powder on surfaces are obtained by means of low-temperature drying. Further, the tobacco powder has a diameter of 150-200 meshes. Further, the temperature of low-temperature drying is 40-60° C. Further, the moisture content of the smoking body is 5-13% after drying.

After the tobacco powder is coated on the surfaces of the particle bodies, the color of the tobacco particles is more attractive and close to the natural color of tobacco. At the same time, the tobacco powder can partially block the atomizer and the tobacco extract inside the particles from leaking to the outside, and form double protection together with the shells to effectively prevent the leakage of the atomizer and the tobacco extract.

Further, after the tobacco particles are mixed with a second binder uniformly, the mixture is placed in the mold and solidified to obtain a finished low-temperature smoking body.

Optionally, a preparation method of the tobacco particles includes the following steps:

(1) weighing 120-200 parts of carrier, 6-45 parts of smoking material and 0-25 parts of wetting agent by mass, followed by uniform mixing and granulation to obtain particle bodies; and (2) coating the soft and moist particles obtained in step (1) with a material with bonding ability as a raw material to prepare shells on surfaces of the particle bodies, thus obtaining finished tobacco particles.

Preferably, the second binder includes at least one of hydroxypropyl cellulose, povidone, and PVP.

The low-temperature smoking body of the present invention can be used for quick and stable smoking of low-temperature cigarette sets or tobacco pipes.

The low-temperature smoking body provided by the present invention belongs to a low-temperature cigarette, that is, generates smoke by heating without burning.

Compared with the prior art, the beneficial effects of the present invention are:

1. The smoking agent inside the tobacco particles used in the present invention is distributed uniformly, so that the smoking stability and uniformity are better.

2. The granulation process of tobacco particles in the present invention includes tobacco powder wrapping and coating to form a core-shell structure, which blocks the internal ingredients of the particles from contacting the outside to a great extent, facilitates storage, and forms double anti-seepage protection to effectively solve the problem of liquid leakage.

3. The shells can be obtained by coating with a material with bonding ability, which cleverly utilizes its insulating ability and bonding ability, and subsequent processing does not require re-sizing, which is more conducive to industrialized mass production.

4. The use of non-tobacco materials in tobacco particles can greatly reduce the release of nicotine during smoking and reduce irritation; at the same time, some non-tobacco materials can give special aromas to meet individual needs.

5. When the porous material is used as the carrier, the porous material does not release nicotine during the heating process, which avoids the problem of excessive nicotine and excessive irritation when the particles are all tobacco materials, and the smoking experience is better.

6. By adding magnetic materials in the tobacco particles, the smoking body can quickly smoke from inside to outside, and the smoking stability and uniformity are better.

7. The low-temperature smoking body of the present invention has a honeycomb porous structure, the whole heat is uniform, the smoke is easy to diffuse, and the smoking is smooth.

8. With the use of tobacco materials, the smoking taste is better, the amount of smoke is sufficient, and the satisfaction is good.

9. Through the special cavity structure, simultaneously heating on four sides and in the center of the low-temperature smoking body can be realized, so that the smoking is quicker.

Figure 1:
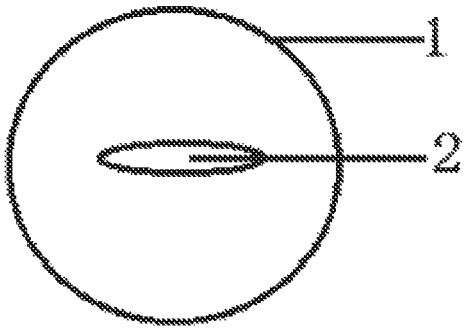
FIG. 1 is a cross-sectional structural schematic diagram of a low-temperature smoking body in Example 12.

In the figures, 1—low-temperature smoking body, 2—cavity structure.

DETAILED DESCRIPTION OF THE EMBODIMENTS

The following examples are intended to illustrate the content of the present invention, rather than to further limit the protection scope of the present invention.

Example 1

A preparation method of a low-temperature smoking body in this embodiment included the following steps:

1) 100 parts of 100-200 mesh tobacco powder was weighed in parts by mass; 6 parts of tobacco extract, 5 parts of glycerin, 10 parts of glycerol and 12 parts of 95% alcohol were weighed, mixed uniformly and then sprayed into the tobacco powder, followed by uniform mixing, extrusion and granulation to obtain soft and moist tobacco particles; 2) 10 parts of 150-200 mesh tobacco powder was weighed and mixed with the soft and moist tobacco particles obtained in step (1), the mixture was rounded and sieved, and 10-40 mesh particles therein were dried at 50° C. to obtain semi-finished tobacco particles; 3) 0.3 part of sodium carboxymethyl cellulose was dissolved in 20 parts of water, the semi-finished tobacco particles were coated with povidone on a fluidized bed, the coating material accounted for 2% of the mass of the tobacco particles, and the moisture of the finished particles was controlled to 15 wt % to obtain required tobacco particles; and 4) a certain mass of tobacco particles was weighed, placed in a special cylindrical cavity mold, appropriately pressed and quickly heated to 100° C., the heat was preserved for a certain time to control the internal moisture of the particles to about 10 wt %, the particles were quickly cooled to room temperature, the tobacco particles in the mold had been bonded into a rod, and the rod was taken out to obtain the required low-temperature smoking body. The low-temperature smoking body can be directly filled into a corresponding low-temperature cigarette set or tobacco pipe as a smoking material, can also be rolled into a cigarette for smoking, and had the advantages of fast smoking, sufficient smoke, good uniformity throughout smoking, many puffs of smoking, good aroma and strong sense of satisfaction.

Example 2

A preparation method of a low-temperature smoking body in this embodiment included the following steps:

1) 100 parts of 100-200 mesh tobacco powder by mass was weighed; 12 parts of tobacco extract, 10 parts of glycerin, 5 parts of propylene glycol and 10 parts of glycerol and 15 parts of water were weighed, mixed uniformly and then sprayed into the tobacco powder, followed by uniform mixing, extrusion and granulation to obtain soft and moist tobacco particles; 2) 20 parts of 150-200 mesh tobacco powder was weighed and mixed with the soft and moist tobacco particles, the mixture was rounded and sieved, and 10-40 mesh particles therein were dried at 50° C. to obtain semi-finished tobacco particles; 3) 1 part of povidone and 0.5 part of polyethylene glycol were dissolved in 20 parts of water, the semi-finished tobacco particles were coated with hydroxypropyl methyl cellulose on a fluidized bed, the coating material accounted for 4% of the mass of the tobacco particles, and the moisture of the finished particles was controlled to 18 wt % to obtain required tobacco particles; and 4) a certain mass of tobacco particles was weighed, placed in a special cylindrical cavity mold, appropriately pressed, treated with microwave for 45 s and quickly cooled to room temperature, the tobacco particles in the mold had been bonded into a rod, and the rod was taken out to obtain the required low-temperature smoking body.

The low-temperature smoking body can be directly filled into a corresponding low-temperature cigarette set or tobacco pipe as a smoking material, can also be rolled into a cigarette for smoking, and had the advantages of fast smoking, sufficient smoke, good uniformity throughout smoking, many puffs of smoking, good aroma and strong sense of satisfaction.

Example 3

A preparation method of a low-temperature smoking body in this embodiment included the following steps:

1) 100 parts of 100-200 mesh tobacco powder and 50 parts of 100-200 mesh microcrystalline cellulose were weighed in parts by mass; 6 parts of tobacco extract, 5 parts of glycerin, 10 parts of glycerol and 12 parts of 95% alcohol were weighed, mixed uniformly and then sprayed into the tobacco powder and the microcrystalline cellulose, followed by uniform mixing, extrusion and granulation to obtain soft and moist tobacco particles; 2) 10 parts of 150-200 mesh tobacco powder was weighed and mixed with the soft and moist tobacco particles obtained in step (1), the mixture was rounded and sieved, and 10-40 mesh particles therein were dried at 50° C. to obtain semi-finished tobacco particles; 3) 0.3 part of sodium carboxymethyl cellulose was dissolved in 20 parts of water to coat the semi-finished tobacco particles, and the moisture of the finished particles was controlled to 15 wt % to obtain required tobacco particles; and 4) a certain mass of tobacco particles was weighed, placed in a special cylindrical cavity mold, appropriately pressed and quickly heated to 100° C., the heat was preserved for a certain time to control the internal moisture of the particles to about 10 wt %, the particles were quickly cooled to room temperature, the tobacco particles in the mold had been bonded into a rod, and the rod was taken out to obtain the required low-temperature smoking body.

The low-temperature smoking body can be directly filled into a corresponding low-temperature cigarette set or tobacco pipe as a smoking material, can also be rolled into a cigarette for smoking, and had the advantages of fast smoking, sufficient smoke, good uniformity throughout smoking, many puffs of smoking, good aroma, moderate nicotine content and less irritation.

Example 4

A preparation method of a low-temperature smoking body in this embodiment included the following steps:

1) 100 parts of 120-200 mesh tobacco powder and 20 parts of 100-200 mesh tea powder were weighed in parts by mass; 12 parts of tobacco extract, 10 parts of glycerin, 5 parts of propylene glycol, 10 parts of glycerol and 15 parts of water were weighed, mixed uniformly and then sprayed into the tobacco powder and the tea powder, followed by uniform mixing, extrusion and granulation to obtain soft and moist tobacco particles; 2) 20 parts of 150-200 mesh tobacco powder was weighed and mixed with the soft and moist tobacco particles obtained in step (1), the mixture was rounded and sieved, and 10-40 mesh particles therein were dried at 50° C. to obtain semi-finished tobacco particles; 3) 1 part of povidone and 0.5 part of polyethylene glycol were dissolved in 20 parts of water to coat the semi-finished tobacco particles, and the moisture of the finished particles was controlled to 18 wt % to obtain required tobacco particles; and 4) a certain mass of tobacco particles was weighed, placed in a special cylindrical cavity mold, appropriately pressed, treated with microwave for 45 s and quickly cooled to room temperature, the tobacco particles in the mold had been bonded into a rod, and the rod was taken out to obtain the required low-temperature smoking body.

The low-temperature smoking body can be directly filled into a corresponding low-temperature cigarette set or tobacco pipe as a smoking material, can also be rolled into a cigarette for smoking, and had the advantages of fast smoking, sufficient smoke, good uniformity throughout smoking, many puffs of smoking, good aroma, light tea fragrance, moderate nicotine content and less irritation.

Example 5

A preparation method of a low-temperature smoking body in this embodiment included the following steps:

1) 100 parts of 120-200 mesh tobacco powder, 30 parts of 100-200 mesh hemp pulp fibers and 20 parts of 150 mesh starch were weighed in parts by mass; 12 parts of tobacco extract, 10 parts of glycerin, 5 parts of propylene glycol, 10 parts of glycerol and 15 parts of water were weighed, mixed uniformly and then sprayed into the tobacco powder and the hemp pulp fibers, followed by uniform mixing, extrusion and granulation to obtain soft and moist tobacco particles; 2) 20 parts of 150-200 mesh tobacco powder was weighed and mixed with the soft and moist tobacco particles, the mixture was rounded and sieved, and 10-40 mesh particles therein were dried at 50° C. to obtain semi-finished tobacco particles; 3) 1 part of povidone and 0.5 part of polyethylene glycol were dissolved in 20 parts of water to coat the semi-finished tobacco particles, and the moisture of the finished particles was controlled to 18 wt % to obtain required tobacco particles; and 4) a certain mass of tobacco particles was weighed, placed in a special cylindrical cavity mold, appropriately pressed, treated with microwave for 45 s and quickly cooled to room temperature, the tobacco particles in the mold had been bonded into a rod, and the rod was taken out to obtain the required low-temperature smoking body.

The low-temperature smoking body can be directly filled into a corresponding low-temperature cigarette set or tobacco pipe as a smoking material, can also be rolled into a cigarette for smoking, and had the advantages of fast smoking, sufficient smoke, good uniformity throughout smoking, many puffs of smoking, good aroma, moderate nicotine content and less irritation.

Example 6

A preparation method of a low-temperature smoking body in this embodiment included the following steps: 1) 5 parts of tobacco extract, 10 parts of glycerol and 5 parts of glycerin were weighed in parts by mass, and mixed uniformly to obtain a smoking agent; 2) 50 parts of 40-60 mesh corncob particles were weighed, and the smoking agent was sprayed onto the corncob particles, followed by uniform mixing; 3) 100 parts of 100-200 mesh tobacco powder was weighed, and 2% carboxymethyl cellulose aqueous solution was prepared as a first binder; 4) with the corncob particles adsorbing the liquid ingredients as cores, a tobacco powder material was wrapped on the surfaces of the corncob particles by using a general method under the action of the first binder, and the particles were dried to the moisture of 10% and sieved to obtain 20-40 mesh tobacco particles for later use; and 5) 5% hydroxypropyl cellulose aqueous solution was prepared as a second binder for molding and sprayed onto the surfaces of the prepared tobacco particles, the both were mixed uniformly, the particles were placed in a special cylindrical cavity mold, appropriately pressed and quickly heated to 100° C., the heat was preserved for a certain time to control the internal moisture of the particles to about 10 wt %, the particles were quickly cooled to room temperature, the tobacco particles in the mold had been bonded into a rod, and the rod was taken out to obtain the required low-temperature smoking body.

The low-temperature smoking body can be directly filled into a corresponding low-temperature cigarette set or tobacco pipe as a smoking material, can also be rolled into a cigarette for smoking, and had the advantages of fast smoking, sufficient smoke, good uniformity throughout smoking, many puffs of smoking, good aroma and strong sense of satisfaction.

Example 7

A preparation method of a low-temperature smoking body in this embodiment included the following steps: 1) 10 parts of tobacco extract, 5 parts of glycerol and 10 parts of glycerin were weighed in parts by mass, and mixed uniformly; 2) 40 parts of 40-60 mesh active carbon was weighed, and the mixed solution was sprayed onto the active carbon powder, followed by uniform mixing; 3) 100 parts of 100-200 mesh tobacco powder was weighed, and 2% carboxymethyl cellulose aqueous solution was prepared as a first binder; 4) with the active carbon particles adsorbing the liquid ingredients as cores, tobacco powder was wrapped on the surface of the active carbon by using a general method under the action of the binder, and the particles were dried to the moisture of 10% and sieved to obtain 20-40 mesh tobacco particles for later use; and 5) 5% PVP aqueous solution was prepared as a second binder for molding and sprayed onto the surfaces of the prepared tobacco particles, the both were mixed uniformly, the particles were placed in a special cylindrical cavity mold, appropriately pressed and quickly heated to 100° C., the heat was preserved for a certain time to control the internal moisture of the particles to about 9 wt %, the particles were quickly cooled to room temperature, the tobacco particles in the mold had been bonded into a rod, and the rod was taken out to obtain the required low-temperature smoking body.

The low-temperature smoking body can be directly filled into a corresponding low-temperature cigarette set or tobacco pipe as a smoking material, can also be rolled into a cigarette for smoking, and had the advantages of fast smoking, sufficient smoke, good uniformity throughout smoking, many puffs of smoking, good aroma and strong sense of satisfaction.

Example 8

A preparation method of a low-temperature smoking body in this embodiment included the following steps: 1) 5 parts of tobacco extract, 10 parts of glycerol and 5 parts of glycerin were weighed in parts by mass, and mixed uniformly; 2) 100 parts of 40-60 mesh porous ceramic particles were weighed, and the mixed solution was sprayed onto the porous ceramic, followed by uniform mixing; 3) 100 parts of 100-200 mesh tobacco powder was weighed, and 5% polyvinyl alcohol aqueous solution was prepared as a first binder; 4) with the porous ceramic particles adsorbing the liquid ingredients as cores, tobacco powder was wrapped on the surface of the porous ceramic by using a general method under the action of the binder, and the particles were dried to the moisture of 10% and sieved to obtain 20-40 mesh tobacco particles for later use; and 5) 5% povidone aqueous solution was prepared as a second binder for molding and sprayed onto the surfaces of the prepared tobacco particles, the both were mixed uniformly, the particles were placed in a special cylindrical cavity mold, appropriately pressed, treated with microwave for 45 s and quickly cooled to room temperature, the tobacco particles in the mold had been bonded into a rod, and the rod was taken out to obtain the required low-temperature smoking body.

The low-temperature smoking body can be directly filled into a corresponding low-temperature cigarette set or tobacco pipe as a smoking material, can also be rolled into a cigarette for smoking, and had the advantages of fast smoking, sufficient smoke, good uniformity throughout smoking, many puffs of smoking, good aroma and strong sense of satisfaction.

Example 9

A preparation method of a low-temperature smoking body in this embodiment included the following steps:

1) 5 parts of tobacco extract, 10 parts of glycerol, and 5 parts of glycerin were weighed and mixed uniformly; 2) 20 parts of 60 mesh iron powder was weighed as cores, 100 parts of 150 mesh tobacco powder and the mixed solution were wrapped on the surface of the iron powder by using a general method under the action of carboxymethyl cellulose, followed by sieving to obtain 20-40 mesh tobacco particles for later use; 3) 5% hydroxypropyl cellulose aqueous solution was prepared as a second binder and sprayed onto the surfaces of the prepared tobacco particles, the both were mixed uniformly, the particles were placed in a special cylindrical cavity mold, appropriately pressed, dried at 50° C. for a period of time to control the internal moisture of the particles to about 10%, and quickly cooled to room temperature, the tobacco particles in the mold had been bonded into a rod, and the rod was taken out to obtain the required particle-based low-temperature smoking body. The low-temperature smoking body can be directly filled into a corresponding low-temperature cigarette set or tobacco pipe as a smoking material, can also be rolled into a cigarette for smoking, and had the advantages of fast smoking, sufficient smoke, good uniformity throughout smoking, many puffs of smoking, good aroma and strong sense of satisfaction.

Example 10

A preparation method of a low-temperature smoking body in this embodiment included the following steps:

1) 10 parts of tobacco extract, 5 parts of glycerol, and 10 parts of glycerin were weighed and mixed uniformly; 2) 15 parts of 70-mesh ferromanganese alloy was weighed as cores, 100 parts of 120-mesh tobacco powder and the mixed solution were wrapped on the surface of the ferromanganese alloy powder by using a general method under the action of carboxymethyl cellulose, and the particles were dried to the moisture of 10% and sieved to obtain 20-40 mesh tobacco particles for later use; 3) 5% PVP aqueous solution was prepared as a second binder and sprayed onto the surfaces of the prepared tobacco particles, the both were mixed uniformly, the particles were placed in a special cylindrical cavity mold, appropriately pressed, dried at 50° C. for a period of time to control the internal moisture of the particles to about 8%, and quickly cooled to room temperature, the tobacco particles in the mold had been bonded into a rod, and the rod was taken out to obtain the required low-temperature smoking body. The low-temperature smoking body can be directly filled into a corresponding low-temperature cigarette set or tobacco pipe as a smoking material, can also be rolled into a cigarette for smoking, and had the advantages of fast smoking, sufficient smoke, good uniformity throughout smoking, many puffs of smoking, good aroma and strong sense of satisfaction.

Example 11

A preparation method of a low-temperature smoking body in this embodiment included the following steps:

1) 5 parts of tobacco extract, 10 parts of glycerol, and 5 parts of glycerin were weighed and mixed uniformly; 2) 15 parts of 70-mesh iron-nickel alloy was weighed as cores, 100 parts of 200-mesh tobacco powder and the mixed solution were wrapped on the surface of the iron-nickel alloy powder by using a general method under the action of polyvinyl alcohol, and the particles were dried to the moisture of 10% and sieved to obtain 20-40 mesh tobacco particles for later use; 3) 5% polyvinyl alcohol aqueous solution was prepared as a second binder and sprayed onto the surfaces of the prepared tobacco particles, the both were mixed uniformly, the particles were placed in a special cylindrical cavity mold, appropriately pressed, dried at 50° C. for a period of time to control the internal moisture of the particles to about 8%, and quickly cooled to room temperature, the tobacco particles in the mold had been bonded into a rod, and the rod was taken out to obtain the required low-temperature smoking body. The low-temperature smoking body can be directly filled into a corresponding low-temperature cigarette set or tobacco pipe as a smoking material, can also be rolled into a cigarette for smoking, and had the advantages of fast smoking, sufficient smoke, good uniformity throughout smoking, many puffs of smoking, good aroma and strong sense of satisfaction.

Example 12

A preparation method of a low-temperature smoking body in this embodiment was as follows:

1) 100 parts of 100-200 mesh tobacco powder, 50 parts of 100-200 mesh microcrystalline cellulose, 6 parts of tobacco extract, 5 parts of glycerin, 10 parts of glycerol, and 12 parts of 95% alcohol were weighed in parts by mass, mixed uniformly and then sprayed into the tobacco powder, followed by uniform mixing, extrusion and granulation to obtain soft and moist tobacco particles; 2) 10 parts of 150-200 mesh tobacco powder was weighed and mixed with the soft and moist tobacco particles, the mixture was rounded and sieved, and 10-40 mesh particles therein were dried at 50° C. to obtain semi-finished tobacco particles; 3) 0.3 part of sodium carboxymethyl cellulose was dissolved in 20 parts of water to coat the semi-finished tobacco particles, and the moisture of the finished particles was controlled to 15% to obtain required tobacco particles; and 4) a certain mass of tobacco particles was weighed, placed in a special cylindrical cavity mold with an elliptical solid column in the center, appropriately pressed and quickly heated to 100° C., the heat was preserved for a certain time to control the internal moisture of the particles to about 10%, the particles were quickly cooled to room temperature, the tobacco particles in the mold had been bonded into a rod, and the rod was taken out to obtain the required all-particle low-temperature smoking body with an elliptical cavity in the center. The low-temperature smoking body can be directly filled into a corresponding four-side heating and/or center heating low-temperature cigarette set as a smoking material, can also be rolled into a cigarette for smoking, and had the advantages of fast smoking, sufficient smoke, good uniformity throughout smoking, many puffs of smoking, and good aroma. The cross-sectional schematic diagram of the smoking body is shown in FIG. 1.

Example 13

Figure 2:
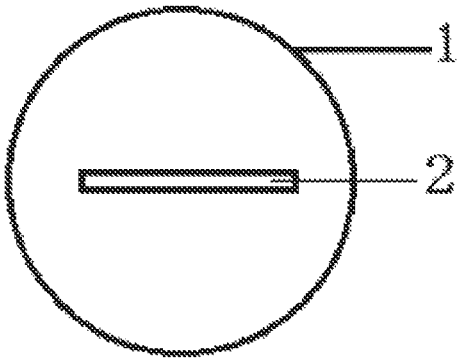
FIG. 2 is a cross-sectional structural schematic diagram of a low-temperature smoking body in Example 13.

A preparation method of a low-temperature smoking body in this embodiment was as follows:

1) 100 parts of 120-200 mesh tobacco powder, 50 parts of 100-200 tea powder, 12 parts of tobacco extract, 10 parts of glycerin, 5 parts of propylene glycol, 10 parts of glycerol, and 15 parts of water were weighed in parts by mass, mixed uniformly and then sprayed into the tobacco powder, followed by uniform mixing, extrusion and granulation to obtain soft and moist particles; 2) 20 parts of 150-200 mesh tobacco powder was weighed and mixed with the soft and moist particles, the mixture was rounded and sieved, and 10-40 mesh particles therein were dried at 50° C. to obtain semi-finished tobacco particles; 3) 1 part of povidone and 0.5 part of polyethylene glycol were dissolved in 20 parts of water to coat the semi-finished tobacco particles, and the moisture of the finished particles was controlled to 18% to obtain required tobacco particles; and 4) a certain mass of tobacco particles was weighed, placed in a special cylindrical cavity mold with a cuboid solid column in the center, appropriately pressed, treated with microwave for 45 s and quickly cooled to room temperature, the tobacco particles in the mold had been bonded into a rod, and the rod was taken out to obtain the required low-temperature smoking body with a cuboid cavity in the center. The low-temperature smoking body can be directly filled into a corresponding four-side heating and/or center heating low-temperature cigarette set, can also be rolled into a cigarette for smoking, and had the advantages of fast smoking, sufficient smoke, good uniformity throughout smoking, many puffs of smoking, good aroma and light tea fragrance. The cross-sectional schematic diagram of the smoking body is shown in FIG. 2.

Example 14

A preparation method of a low-temperature smoking body in this embodiment was as follows:

1) 100 parts of 120-200 mesh tobacco powder, 30 parts of 100-200 tea hemp pulp fibers, 20 parts of 150-mesh starch, 12 parts of tobacco extract, 10 parts of glycerin, 5 parts of propylene glycol, 10 parts of glycerol, and 15 parts of water were weighed in parts by mass, mixed uniformly and then sprayed into the tobacco powder, followed by uniform mixing, extrusion and granulation to obtain soft and moist particles; 2) 20 parts of 150-200 mesh tobacco powder was weighed and mixed with the soft and moist particles, the mixture was rounded and sieved, and 10-40 mesh particles therein were dried at 50° C. to obtain semi-finished tobacco particles; 3) 1 part of povidone and 0.5 part of polyethylene glycol were dissolved in 20 parts of water to coat the semi-finished tobacco particles, and the moisture of the finished particles was controlled to 18% to obtain required tobacco particles; and 4) a certain mass of tobacco particles was weighed, placed in a special cylindrical cavity mold with a circular solid column in the center, appropriately pressed, treated with microwave for 45 s and quickly cooled to room temperature, the tobacco particles in the mold had been bonded into a rod, and the rod was taken out to obtain the required low-temperature smoking body with a circular cavity in the center.

Figure 3:
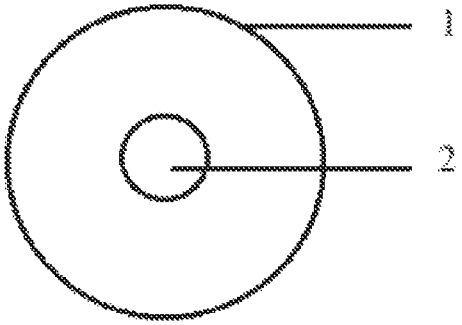
FIG. 3 is a cross-sectional structural schematic diagram of a low-temperature smoking body in Example 14.

The low-temperature smoking body can be directly filled into a corresponding four-side heating and/or center heating low-temperature cigarette set, can also be rolled into a cigarette for smoking, and had the advantages of fast smoking, sufficient smoke, good uniformity throughout smoking, many puffs of smoking, good aroma, moderate nicotine content and less irritation. The cross-sectional schematic diagram of the smoking body is shown in FIG. 3.

The contents illustrated by the above embodiments should be understood as these embodiments are merely used for illustrating the present invention more clearly, rather than limiting the scope of the present invention. Various equivalent modifications made to the present invention by those skilled in the art after reading the present invention all fall within the scope defined by the appended claims of the present application.

The invention claimed is:

1. A low-temperature smoking body, comprising a plurality of tobacco particles, wherein:

a tobacco particle comprises a particle body and a shell wrapped on the particle body, the shell individually wrapping the particle body, the shell individually wrapping the particle body, the tobacco particle having a diameter of 10-40 meshes, the shell is made of a material with a bonding ability, the shell contains one or more of hydroxypropyl cellulose, povidone, sodium carboxymethyl cellulose, microcrystalline cellulose, polyethylene glycol, and polyvinyl alcohol, a carrier is distributed in the particle body, or a carrier is distributed in the particle body and the shell, the carrier comprises at least one of a raw tobacco material, a non-tobacco material, and a porous material, the carrier carries a smoking agent, the smoking agent comprises a tobacco extract and/or an atomizing agent, a tobacco powder layer is also provided between the particle body and the shell, the tobacco powder layer is made of tobacco powders, and the tobacco powder has a diameter of 150-200 meshes, and the tobacco powder layer is coated on the surface of the particle body.

2. The low-temperature smoking body according to claim 1, wherein:

the smoking agent comprises a tobacco extract and an atomizing agent, and the mass ratio of the carrier, the tobacco extract, and the atomizing agent is (50-150):(1-15):(5-30).

3. The low-temperature smoking body according to claim 1, wherein:

the porous material comprises an organic porous material;

further, the porous material comprises at least one of corncob particles, rice husk particles, walnut shell particles, grapefruit peel particles, tobacco stem particles, tea particles, porous silica gel, active carbon, porous ceramic particles, and porous molecular sieves; and further, the non-tobacco material comprises at least one of microcrystalline cellulose, tea, hemp pulp fibers, bamboo fibers, coconut fibers, starch, coffee shells, and mint leaves.

4. The low-temperature smoking body according to claim 1, wherein:

the porous material comprises an inorganic porous material;

further, the porous material comprises at least one of corncob particles, rice husk particles, walnut shell particles, grapefruit peel particles, tobacco stem particles, tea particles, porous silica gel, active carbon, porous ceramic particles, and porous molecular sieves; and further, the non-tobacco material comprises at least one of microcrystalline cellulose, tea, hemp pulp fibers, bamboo fibers, coconut fibers, starch, coffee shells, and mint leaves.

5. The low-temperature smoking body according to claim 1, wherein:

a magnetic material is distributed in the particle bodies, and preferably, the magnetic material comprises at least one of ferrite, iron alloy, and nickel alloy.

6. The low-temperature smoking body according to claim 1, wherein:

the carrier has a particle size of 40-80 meshes; and the moisture content of the tobacco particle is 8-25 wt %.

7. The low-temperature smoking body according to claim 1, wherein:

the mass ratio of the tobacco powder layer to the particle body is 100:(5-25).

8. The low-temperature smoking body according to claim 1, wherein the mass ratio of the shell to the tobacco particle is (0.1-5):100.

9. The low-temperature smoking body according to claim 1, wherein the shell contains a tobacco powder material.

10. The low-temperature smoking body according to claim 2, wherein the shell contains a tobacco powder material.

11. The low-temperature smoking body according to claim 1, wherein:

the low-temperature smoking body has a porous and air-permeable structure, and its internal effective porosity is 65-95%; and preferably, the moisture content of the low-temperature smoking body is 5-13 wt %.

12. The low-temperature smoking body according to claim 2, wherein:

the low-temperature smoking body has a porous and air-permeable structure, and its internal effective porosity is 65-95%; and preferably, the moisture content of the low-temperature smoking body is 5-13 wt %.

13. The low-temperature smoking body according to claim 1, wherein:

the low-temperature smoking body has a cavity structure;

further, the low-temperature smoking body is cylindrical, the cavity structure extends along the length of the low-temperature smoking body, preferably, the cross section of the cavity structure is one of circle, ellipse, square, and rhombus;

preferably, the moisture content of the low-temperature smoking body is 6-12 wt %, and further, the effective porosity of the solid part of the low-temperature smoking body is 40-80%.

14. The low-temperature smoking body according to claim 2, wherein:

the low-temperature smoking body has a cavity structure;

further, the low-temperature smoking body is cylindrical, the cavity structure extends along the length of the low-temperature smoking body, preferably, the cross section of the cavity structure is one of circle, ellipse, square, and rhombus;

preferably, the moisture content of the low-temperature smoking body is 6-12 wt %, and further, the effective porosity of the solid part of the low-temperature smoking body is 40-80%.

15. A preparation method of a low-temperature smoking body comprising tobacco particles, the preparation method comprising:

placing the tobacco particles in a mold to solidify to obtain the finished low-temperature smoking body, wherein a tobacco particle of the tobacco particles comprises a particle body and a shell wrapped on the particle body; and distributing a carrier in a particle body and/or a shell, wherein:

the carrier comprises at least one of a raw tobacco material, a non-tobacco material, and a porous material, the carrier carries a smoking agent, and the smoking agent comprises a tobacco extract and/or an atomizing agent.

* * * * *